US008599010B2

(12) United States Patent
Bose et al.

(10) Patent No.: US 8,599,010 B2
(45) Date of Patent: Dec. 3, 2013

(54) WIRELESS TRANSCEIVER FOR FIREFIGHTER SAFETY

(75) Inventors: Abhijit Bose, Bangalore (IN); Mohammed Rizwan, Bangalore (IN); Vinayak Sadashiv Kore, Bangalore (IN); Andrew G. Berezowski, Wallingford, CT (US)

(73) Assignee: Honeywell International Inc., Morristown, NJ (US)

( * ) Notice: Subject to any disclaimer, the term of this patent is extended or adjusted under 35 U.S.C. 154(b) by 343 days.

(21) Appl. No.: 12/967,676

(22) Filed: Dec. 14, 2010

(65) Prior Publication Data

US 2012/0146787 A1 Jun. 14, 2012

(51) Int. Cl.
*G08B 1/08* (2006.01)

(52) U.S. Cl.
USPC ..... 340/539.13; 340/825.49; 340/572.1; 340/573.1; 342/357.06; 455/100

(58) Field of Classification Search
USPC ..... 340/539.13, 825.49, 572.1, 10.1, 573.1; 342/357.06; 455/100
See application file for complete search history.

(56) References Cited

U.S. PATENT DOCUMENTS

| | | | | |
|---|---|---|---|---|
| 4,906,972 | A * | 3/1990 | Spencer | 340/539.11 |
| 7,005,980 | B1 * | 2/2006 | Schmidt et al. | 340/539.13 |
| 7,377,835 | B2 * | 5/2008 | Parkulo et al. | 455/521 |
| 2007/0194913 | A1 * | 8/2007 | Yokoshima et al. | 340/539.26 |
| 2010/0146426 | A1 * | 6/2010 | Parkulo et al. | 715/769 |

* cited by examiner

*Primary Examiner* — Steven Lim
*Assistant Examiner* — Hongmin Fan
(74) *Attorney, Agent, or Firm* — Husch Blackwell LLP

(57) ABSTRACT

A firefighter tracking system is provided for use in conjunction with a fire truck to track firefighters at the scene of a fire. The system a plurality of portable wireless transceiver tags each carried by a respective firefighter, an accelerometer within each of the plurality of portable wireless transceiver tags, a motion processor within each of the plurality of portable wireless transceiver tags coupled to the accelerometer, the motion processor processes information from the accelerometer, detects an immobilized state of the respective firefighter and wirelessly transmits information including a notification of the detected immobilized state, a gateway carried by the fire truck that receives the transmitted information from each of the plurality of portable wireless transceivers and a status processor coupled to the gateway within the fire truck programmed to determine and display a status of at least some of the firefighters at the location of the fire via the received information including at least the immobilized state of the at least some of the firefighters.

13 Claims, 3 Drawing Sheets

WIRELESS TRANSCEIVER FOR FIREFIGHTER SAFETY

FIELD OF THE INVENTION

The field of the invention relates to wireless communication systems and more particularly to wireless tracking of fireman.

BACKGROUND OF THE INVENTION

Communication among public safety personnel, such as firemen, is an important aspect of safely fighting fires. In large buildings, firefights are often required to attack fires from multiple directions in order to prevent the fire from spreading. In such cases, different teams of firefighters are often assigned to attack the fire from the different directions. Often the efforts of the teams to fight the fire are made more difficult by smoke that obscures the flames or avenues for accessing a fire.

In addition to fighting the actual fire, firefighters may encounter situations where the buildings occupants are still present within the building. In such cases, occupants may feel trapped by the smoke or flames or from fear of becoming lost within a smoke-filled building.

Where occupants are present, firefighters are often required to search for and lead occupants to safety before they can begin to fight the fire. In large structures, the very size of the structures may require that individual firefights fan out within the structure to search for occupants or victims of the fire.

In some cases, a great deal of time may be lost searching for occupants. Where the structure or number of occupants is large, a great deal of time may be spent looking for occupants while the fire continues to spread. Alternatively, a fire may not be discovered and firefighters may not be notified until the fire is well developed.

In either case, the search for occupants may be curtailed by the possibility that parts of the structure may be unstable and subject to collapse. Because of such risks, firefighters may only have a very limited time to search for occupants. Because of the danger to firefighters, better methods are needed to monitor firefighters.

DETAILED DESCRIPTION OF AN ILLUSTRATED EMBODIMENT OF THE INVENTION

Figure 1:
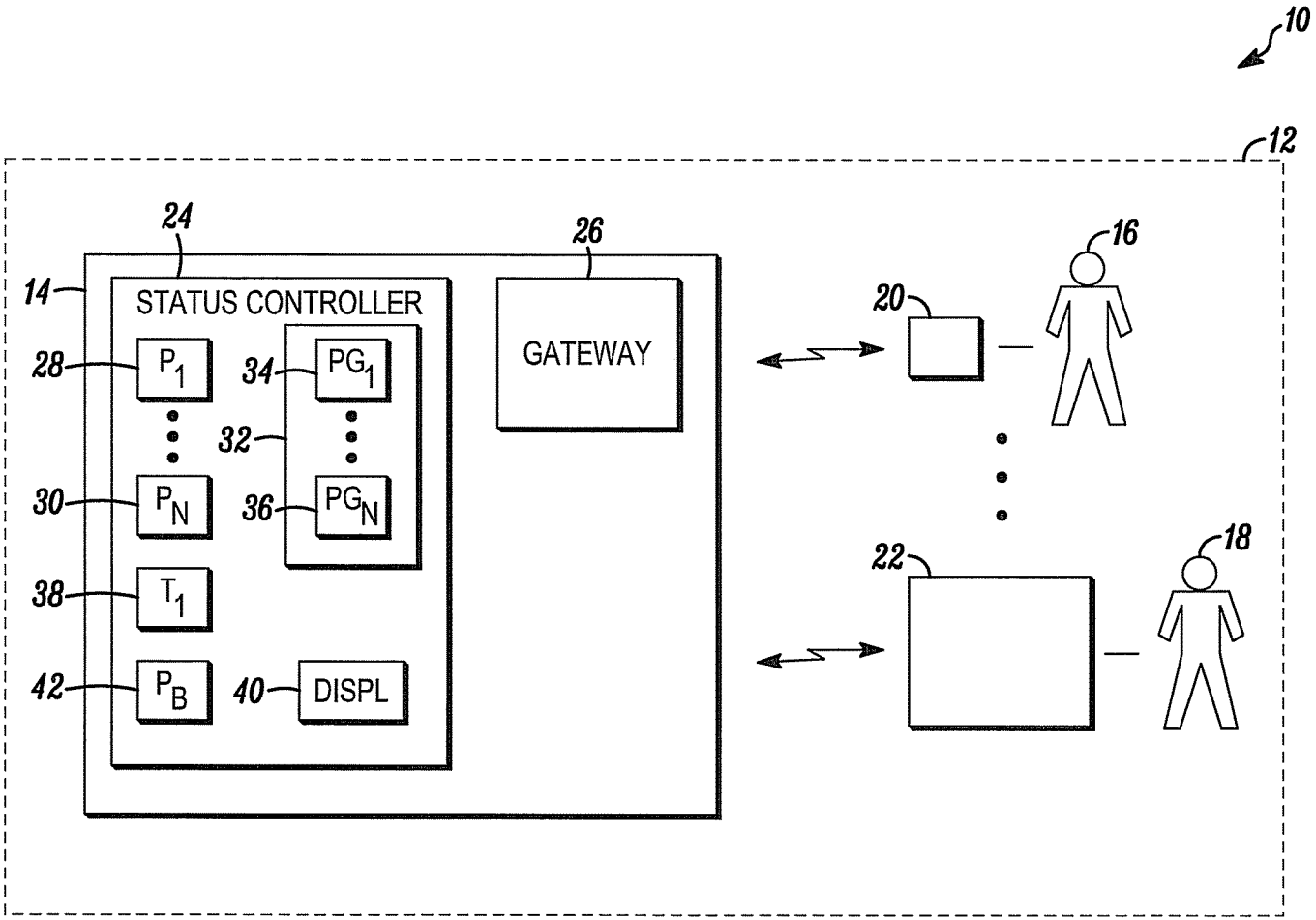
FIG. 1 is a block diagram of a fire scene communication system shown generally in accordance with an illustrated embodiment of the invention.

FIG. 1 depicts a communication system 10 used by a fire department at the scene 12 of a fire, shown generally in accordance with an illustrated embodiment of the invention. In this regard, the communication system 10 may be used by a number of firefighters 16, 18 supported by a fire truck 14. In this regard, each of the firefighters 16, 18 may be provided with a wireless transceiver tag 20, 22.

In this regard, the wireless transceiver tags 20, 22 may be small portable devices. The wireless transceiver tags 20, 22 can be attached to the clothing of or on (or inside) the helmet of a firefighter 16, 18.

Associated with the fire truck 14 may be a gateway 26 and a status controller 24. The status controller 24 and gateway 26 together operate to form a wireless communication connection with each of the wireless transceiver tags 20, 22.

Included within the status controller 24 may be a number of programmed processors 28, 30. The processors 28, 30 may be programmed with one or more programs 34, 36 loaded from a non-transitory computer readable medium 32. The gateway 26 and each of wireless transceiver tags 20, 22 may also operate under the control of one or more programmed processors 28, 30.

Figure 3:
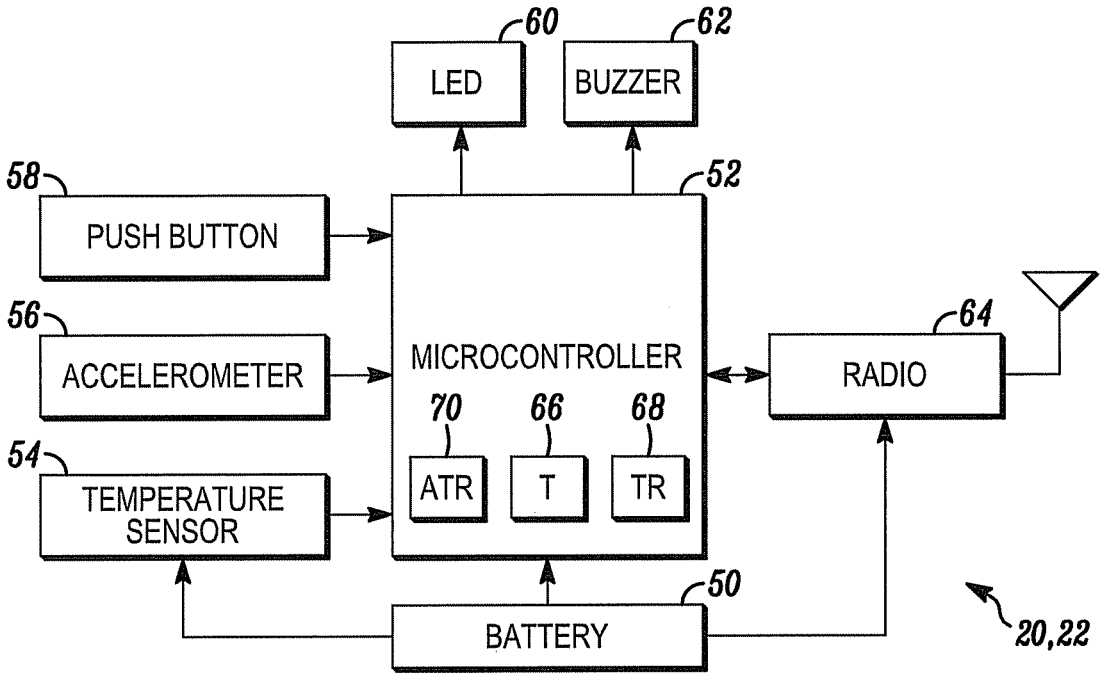
FIG. 3 is a block diagram of a wireless transceiver tag that may be used by the system of FIG. 1.

FIG. 3 is a block diagram of wireless transceiver tags 20, 22. Included within each of the wireless transceiver tags 20, 22 may be a microcontroller 52 powered by a battery 50. The microcontroller 52 may receive inputs from one or more pushbuttons 58, an accelerometer 56 and a temperature sensor 54. The microcontroller 52 may also control a number of outputs including a buzzer 62 and/or LED 60. The microcontroller 52 may also exchange information with the gateway 26 through a radio 64 and antenna.

Figure 2:
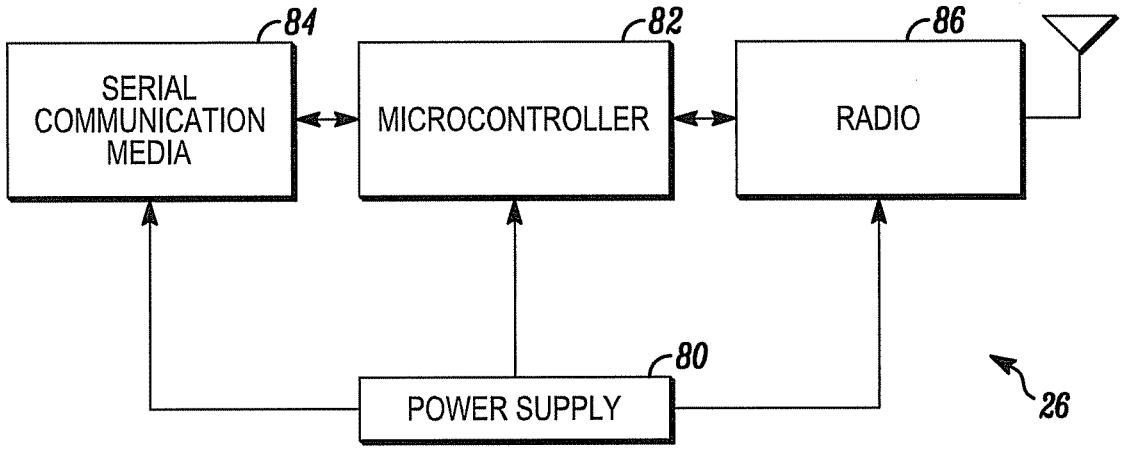
FIG. 2 is a block diagram of a gateway that may be used by the system of FIG. 1.

FIG. 2 is a block diagram of the gateway 26. The gateway 26 may include a microcontroller 82 powered from a power supply 80. The gateway 26 may exchange signals with each of the wireless transceiver tags 20, 22 through a radio 86 and antenna. The microcontroller 82 may also operate as a conduit to exchange information between each of the plurality of wireless transceiver tags 20, 22 and the status processor 24 through the serial communication media or controller 84.

Figure 4:
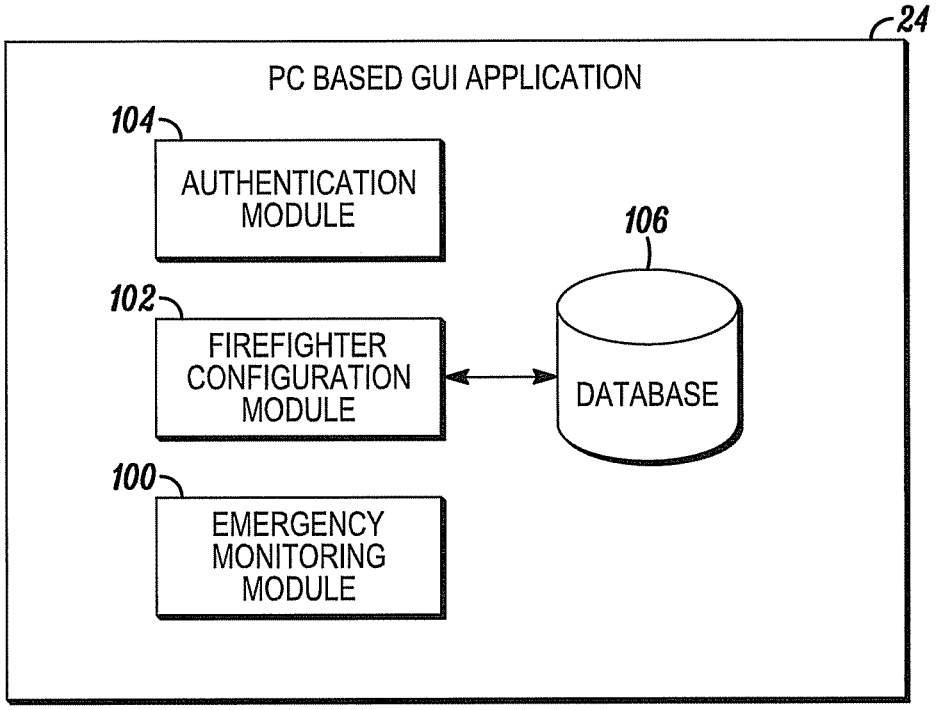
FIG. 4 is a block diagram of a status controller that may be used by the system of FIG. 1.

FIG. 4 is a block diagram of the status controller 24. Included within the status controller 24 may be a database 106, an authentication module 104, a firefighter configuration module 102 and an emergency monitoring module 100.

In general, each of the wireless transceiver tags 20, 22 and the status controller 24 may operate independently of each other to accomplish certain communication functions through the gateway 26. The wireless transceiver tags 20, 22 operate to monitor the activity and environment of the respective firefighter 16, 18. The status controller 24 operates to detect messages from the wireless transceiver tags 20, 22 and to convey messages to the tags 20, 22.

For example, a heartbeat processor 28, 30 within the status gateway 26 may periodically send a heartbeat message to each of the wireless transceiver tags 20, 22. In this regard, a heartbeat message is a message requiring a response from the wireless transceiver tag 20, 22. More specifically, the heartbeat processor 28, 30 monitors a timer 38 provided for each wireless transceiver tag 20, 22. If the heartbeat processor 28, 20 does not receive a message from the wireless transceiver module 20, 22 within a time period established by the timer 38, the heartbeat processor 28, 30 sends a message to the system address for the wireless transceiver tag 20, 22, requesting an acknowledgement from the wireless transceiver tag 20, 22. At the same time, the heartbeat processor 28, 30 also activates a second timer 38. If the heartbeat processor 28, 30 does not receive an acknowledgement before expiration of a second predetermined time period, then the heartbeat processor 28, 30 generates a warning message that is presented on a display 40 notifying a human user of the system 10 that the respective firefighter 16, 18 associated with the wireless transceiver tag 20, 22 cannot be contacted.

Similarly, a heartbeat processor 28, 30 within each of the wireless transceiver tags 20, 22 performs the same function. As with the heartbeat processor within the gateway 26, the heartbeat processor 28, 30 within each of the wireless transceiver tags 20, 22 monitors a time period between messages from the status gateway 26. If a message is not received, then the heartbeat controller 28, 30 sends a request to the status controller 24. In this case, if the heartbeat controller 28, 30 within the wireless transceiver tag 20, 22 does not receive a response within a predetermined time period, then the heartbeat processor 28, 30 activates the buzzer 62 or LED 60 to notify the respective firefighter 16, 18 that he/she is out of communication range of the fire truck 14.

In another aspect, the system 10 also operates to keep track of the number of firefighters 16, 18 that are working in the region of the fire 12. In this regard, each time a new firefighter 16, 18 arrives at the scene of the fire 12, that firefighter 16, 18 may activate a register pushbutton 58 on the wireless transceiver tag 20, 22. In response, a registration processor 28, 30 within the wireless transceiver tag 20, 22 may compose a registration message and transmit the registration message to the status controller 24 including a system identifier of the wireless transceiver tag 20, 22.

The registration message may be processed within the authentication module 102 and configuration module 102 to first authenticate the sender of the message and then to configure the wireless transceiver tag 20, 22. Once authenticated, a corresponding registration processor 28, 30 within the status controller 24 adds the identifier of the wireless transceiver tag 20, 22 to a roll of firefighters 16, 18 operating at the scene 12 of the fire. The roll of firefighters 16, 18 may be used by the heartbeat processor 28, 20 to transmit heartbeat messages to each of the wireless transceiver tags 20, 22 operating at the scene 12 of the fire.

Similarly, the respective firefighters 16, 18 may activate a deactivation or deregistration pushbutton 58 when they leave the scene 12 of the fire. In this case, the registration processor 28, 30 removes the firefighter's name from the roll of firefighters 16, 18 present at the scene 12 of the fire.

Each of the wireless transceiver tags 20, 22 also functions to monitor the environment and activity of the respective firefighter 16, 18 and transmit messages in response thereto. With regard to environment, a temperature processor 28, 30 within the wireless transceiver tag 20, 33 may periodically sense and measure a temperature of the area in which the respective fireman 16, 18 is operating via a temperature sensor 54.

The temperature processor 28, 30 may also compare the measured temperature with a predetermined threshold value 66. If the temperature processor 28, 30 determines that the measured temperature exceeds the threshold value 66, then the temperature processor sends a high temperature alert to the status processor 24. The temperature processor 28, 30 may also activate the buzzer 62 and/or LED to warn the firefighter 16, 18 of the dangerous temperature.

A corresponding temperature processor 28, 30 within the status controller 24 may receive the message and (by reference to the roll of firefighters) determine the identity of the firefighter 16, 18. The temperature processor 28, 30 may also display the identifier of the firefighter 16, 18 and measured temperature on the display 40.

An acceleration processor 28, 30 of each of the wireless transceiver tags 20, 22 may also monitor the accelerometer 56 to detect movement (e.g., a gait) of the respective firefighter 16, 18. If the acceleration processor 28, 30 detects no motion or motion below a predetermined threshold, then the acceleration processor 28, 30 activates a first timer 68. The first timer 68 remains activated for as long as the motion is below a motion threshold 70. If the detected motion increases to exceed the threshold 70, the acceleration processor 28, 30 resets the timer 68. If a time value of the first timer 68 exceeds a predetermined time value established by the timer 68, then the acceleration processor 28, 30 activates the buzzer 62 and/or the LED 60 as a warning to the firefighter 16, 18. The acceleration processor 28, 30 may also activate a second timer 68 or continue to monitor the first timer 68 with respect to a second predetermined time threshold. If the time exceeds the second predetermined time threshold, then the acceleration processor 28, 30 sends a man down (or no motion) message to an emergency monitoring module 100 within the status processor 24.

Within the emergency monitoring module 100, a motion (or man down) processor 28, 30 detects the absence of motion and correlates the man down message with an identifier of the fireman 16, 18. Upon identifying the firefighter 16, 18, the motion processor 28, 30 may display an alert to the user of the system 10 notifying the user that the firefighter 16, 18 may be trapped or unconscious. This notification allows a rescue effort to be mobilized with a minimum of lost time.

In another embodiment, the status controller 24 includes an evacuation feature that may be controlled by an evacuation processor 28, 30. In this case, the evacuation processor 28, 30 detects a need to evacuate the scene 12 of firefighters 16, 18 and sends an evacuation message to each wireless transceiver tag 20, 22. Upon receipt of the evacuation message, the wireless transceiver tags 20, 22 may activate the buzzer 62 and/or LED 60 with a particular evacuation sequence or cadence that is different from the high temperature or man down warnings. Based upon the evacuation message, all firemen 16, 18 may be instructed to evacuate the scene 12 in an orderly manner with reduced risk to the fireman 16, 18.

The evacuation processor 28, 30 may be activated by a number of inputs. For example, an evacuation pushbutton 42 may be provided that may be activated by a fire chief when a fire at the scene 12 has grown out of control. Alternatively, the evacuation processor 28, 30 may be activated by other inputs, such as the temperature processor 28, 30 within the status controller 24 based upon the temperature readings from one or more of the wireless transceiver tags 20, 22.

In general, the tags 20, 22 are much easier to use than conventional radios used by public safety personnel. The tags are easily adapted into the existing uniforms of firefighters so that the firefighter does not need to carry any additional communication devices.

The system 10 consists of a number of wireless devices 20, 22 powered by a battery that is capable of communicating with the fire truck 14 so long as the fireman is on the scene 12. The heart beat feature functions to notify the firefighter in the event that they enter an area where communication may be lost.

The device 20, 22 has an onboard accelerometer to track the movement of the firefighter 16, 18 and to detect if they are unconscious or not moving for any reason. The device 20, 22 can also update the fire truck 14 about local temperatures via the onboard temperature sensor.

Since the device 20, 22 is completely autonomous after the fireman enters the scene 12, the tags 20, 22 don't need any intervention from the firefighter in order to perform their functions. The device 20, 22 is compact enough to fit within the helmet of the firefighter. In the event that a fire gets out of control, the truck can issue a command to all of the firefighters to evacuate the fire scene 12.

A specific embodiment of a communication system for a fire scene has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A firefighter tracking system used in conjunction with a fire truck to track firefighters at the scene of a fire, the system comprising:

a plurality of portable wireless transceiver tags each carried by a respective firefighter;

a registration pushbutton located on each of the plurality of portable wireless transceiver tags, the respective firefighter activates the registration pushbutton each time the respective firefighter arrives at the scene of the fire and the firefighter tracking system adds the respective firefighter to a roll of firefighters operating at the scene of the fire;

a deregistration pushbutton located on each of the plurality of portable wireless transceiver tags, the respective firefighter activates the deregistration pushbutton each time the respective firefighter leaves the scene of the fire and the firefighter tracking system removes the respective firefighter from the roll of firefighters operating at the scene of the fire;

an accelerometer within each of the plurality of portable wireless transceiver tags;

a motion processor within each of the plurality of portable wireless transceiver tags coupled to the accelerometer, the motion processor processes information from the accelerometer, detects an immobilized state of the respective firefighter and wirelessly transmits information including a notification of the detected immobilized state;

a gateway carried by the fire truck that receives the transmitted information from each of the plurality of portable wireless transceivers; and a status processor coupled to the gateway within the fire truck programmed to determine and display a status of at least some of the firefighters on the roll of firefighters operating at the location of the fire via the received information including at least the immobilized state of the at least some of the firefighters, wherein each of the plurality of portable wireless transceiver tags is completely autonomous and doesn't need any intervention from the respective firefighter in order to perform its functions after the respective firefighter enters the scene of the fire, wherein each of the plurality of wireless transceiver tags further comprise a first motion timer and an audible annunciator, the first motion timer is activated by the motion processor upon detecting the immobilized state, the audible annunciator is activated at the end of a first predetermined time period measured by the first motion timer and wherein each of the plurality of wireless transceiver tags further comprise a second motion timer, the second motion timer is activated by the motion processor at the end of the first predetermined time period, the motion processor transmits notification of the immobilized state to the gateway at the end of a second predetermined time period measured by the second motion timer.

2. The system as in claim 1 wherein each of the plurality of wireless transceiver tags further comprise a reset pushbutton activated by the respective fireman that resets the first and second motion timers.

3. The system as in claim 1 wherein each of the plurality of wireless transceiver tags further comprise a temperature sensor that measures a temperature in an environment of the respective firefighter.

4. The system as in claim 3 wherein each of the plurality of wireless transceiver tags further comprise a temperature processor that compares the measured temperature with a predetermined threshold temperature and transmits a temperature warning to the status processor upon detecting that the measured temperature exceeds the threshold temperature.

5. The system as in claim 1 wherein each of the plurality of wireless transceiver tags further comprise a heartbeat processor that periodically transmits a heartbeat message to the gateway and notifies the respective firefighter upon failure to detect a response from the gateway.

6. The system as in claim 1 wherein the gateway further comprise a heartbeat processor that periodically transmits a heartbeat message to each of the plurality of wireless transceiver tags and displays notification of an identifier of each of the plurality of wireless transceiver tags that fails to respond.

7. The system as in claim 1 wherein each of the plurality of wireless transceiver tags further comprises a timer that periodically causes the wireless transceiver tag to transmit a status report to the gateway.

8. The system as in claim 1 further comprising an evacuation order processor coupled to one of the gateway and status processor that causes the gateway to transmit an evacuation message to each of the firefighters present at the scene of the fire through their respective wireless transceiver tags.

9. A firefighter tracking system used in conjunction with a fire truck to track firefighters at the scene of a fire, the system comprising:

a plurality of portable wireless transceiver tags each carried by and that detect movement including immobilization of a respective firefighter and that transmit information including a notification associated with the detected movement of the firefighter;

a registration pushbutton located on each of the plurality of portable wireless transceiver tags, the respective firefighter activates the registration pushbutton each time the respective firefighter arrives at the scene of the fire and the firefighter tracking system adds the respective firefighter to a roll of firefighters operating at the scene of the fire;

a deregistration pushbutton located on each of the plurality of portable wireless transceiver tags, the respective firefighter activates the deregistration pushbutton each time the respective firefighter leaves the scene of the fire and the firefighter tracking system removes the respective firefighter from the roll of firefighters operating at the scene of the fire;

a gateway carried by the fire truck that receives the transmitted information from each of the plurality of portable wireless transceivers; and a status processor coupled to the gateway within the fire truck programmed to determine and display a status of at least some of the firefighters on the roll of firefighters operating at the location of the fire via the received information including at least the immobilized state of the at least some of the firefighters, wherein each of the plurality of portable wireless transceiver tags is completely autonomous and doesn't need any intervention from the respective firefighter in order to perform its functions after the respective firefighter enters the scene of the fire, wherein each of the plurality of wireless transceiver tags further comprise a motion processor, a motion timer and an audible annunciator, the motion timer is activated by the motion processor upon detecting the immobilized state, the audible annunciator is activated at the end of a first predetermined time period measured by the first motion timer, the motion processor transmits notification of the immobilized state to the gateway at the end of a second predetermined time period measured by the second motion timer.

10. The system as in claim 9 further comprising an accelerometer and an accelerometer processor that measure acceleration via the accelerometer and compares the measured acceleration with a threshold value.

11. A firefighter tracking system used in conjunction with a fire truck to track firefighters at the scene of a fire, the system comprising:

a plurality of portable wireless transceiver tags each carried by and that detect movement including immobilization of a respective firefighter and that transmit information including a notification associated with the detected movement of the firefighter;

a registration pushbutton located on each of the plurality of portable wireless transceiver tags, the respective firefighter activates the registration pushbutton each time the respective firefighter arrives at the scene of the fire and the firefighter tracking system adds the respective firefighter to a roll of firefighters operating at the scene of the fire;

a deregistration pushbutton located on each of the plurality of portable wireless transceiver tags, the respective firefighter activates the deregistration pushbutton each time the respective firefighter leaves the scene of the fire and the firefighter tracking system removes the respective firefighter from the roll of firefighters operating at the scene of the fire;

a status processor within the fire truck programmed to receive the transmitted information and to determine and display a status of at least some of the firefighters on the roll of firefighters operating at the location of the fire via the received information including at least the immobilized state of the at least some of the firefighters, wherein each of the plurality of portable wireless transceiver tags is completely autonomous and doesn't need any intervention from the respective firefighter in order to perform its functions after the respective firefighter enters the scene of the fire;

a gateway within the fire truck that detect entry of each of the wireless transceiver tags into the fire scene via activation of the registration pushbutton wherein each of the plurality of wireless transceiver tags further comprise a motion processor, a motion timer and an audible annunciator, the motion timer is activated by the motion processor upon detecting the immobilized state, the audible annunciator is activated at the end of a first predetermined time period measured by the first motion timer, the motion processor transmits notification of the immobilized state to the gateway at the end of a second predetermined time period measured by the second motion timer.

12. The system as in claim 9 further comprising an accelerometer that measure the immobilized state of the firefighter.

13. The system as in claim 9 further comprising a heartbeat processor that displays notification upon detecting absence of communication from one of the plurality of wireless transceiver modules for a predetermined period of time.

* * * * *